United States Patent [19]

Martin et al.

[11] 4,327,172

[45] Apr. 27, 1982

[54] PHOTOGRAPHIC IMAGE DEFINITION IMPROVEMENT

[75] Inventors: Charles E. Martin, Lewisville, N.C.; Ervin J. Rachwal, Framingham, Mass.

[73] Assignee: Western Electric Company, Inc., New York, N.Y.

[21] Appl. No.: 217,058

[22] Filed: Dec. 16, 1980

[51] Int. Cl.[3] ..... G03C 5/50

[52] U.S. Cl. ..... 430/407; 430/406; 430/411; 430/934

[58] Field of Search ..... 430/140, 407, 411, 434, 430/412, 406, 934

[56] References Cited

U.S. PATENT DOCUMENTS

| | | | |
|---|---|---|---|
| 1,552,791 | 9/1925 | Capstaff | 430/407 |
| 2,314,380 | 3/1943 | Alburger | 430/407 |
| 2,327,822 | 8/1943 | Russell et al. | 430/407 |
| 3,206,313 | 9/1965 | Porter et al. | 430/138 |
| 3,282,208 | 11/1966 | Ruderman | 430/142 |
| 3,317,322 | 5/1967 | Porter et al. | 430/567 |
| 3,367,778 | 2/1968 | Berriman | 430/411 |
| 3,591,378 | 7/1971 | Altman | 430/326 |
| 3,632,340 | 1/1972 | Illingsworth | 430/411 |
| 3,945,827 | 3/1976 | Brown | 430/314 |
| 4,108,661 | 8/1978 | Vanassche | 430/407 |

FOREIGN PATENT DOCUMENTS

| | | | |
|---|---|---|---|
| 446172 | 4/1936 | United Kingdom | 430/411 |

OTHER PUBLICATIONS

PSA-MPD Course in Motion Pictures (Lesson Four--Film by George W. Cushman) APSA, PSA Journal, 1959, Nov. pp. 43-46.

James, Theory of the Photographic Process, 3rd Ed., 1966, pp. 150, 152, 154.

DuPont Computer Output Microfilm Training Seminar", 1973 by E. I. Du Pont de Nemours & Co., Section 4, and pp. 5-1, 5-2, 5-3.

Data Release, Kodaline Reproduction Film 2566 and 4566, Kodak Publication No. P-235, 4/75.

Neblette's Handbook of Photography and Reprogaphy, 1977, pp. 29, 63-65.

Stevens, Microphotograpy-Photograph and Photofabrication at Extreme Resolution, 1968, pp. 90, 91, 478.

Data Sheet on Kodak Precision Line Film LPD4 and LPD7, KP0 73556b.

Technical Data Sheet for Cronalar SD Direct Positive Film, SD-4 & SD-7, by E. I. Du Pont de Nemours & Co.

*Primary Examiner*—Mary F. Downey

*Attorney, Agent, or Firm*—W. G. Dossé; R. D. McBurnett

[57] ABSTRACT

The definition of a photographic emulsion of the positive acting type that would normally produce a positive image is improved by normally exposing the emulsion to actinic radiation and developing the photographic emulsion, bleaching it, exposing the emulsion again to actinic radiation and redeveloping it to reverse the image that would normally result on the film.

6 Claims, 4 Drawing Figures

PHOTOGRAPHIC IMAGE DEFINITION IMPROVEMENT

FIELD OF THE INVENTION

The present invention relates to photography and more particularly, to a method for improving the image definition, preferably in high-contrast microphotographs.

BACKGROUND OF THE INVENTION

In normal photographic film, an emulsion containing silver halide covers a transparent substrate. The silver halide in the emulsion is sensitized in those areas that are exposed to actinic radiation. The degree of sensitizing of every area of the emulsion is a function of the intensity and duration of the radiation striking that area. The latent image of sensitized silver halide that is formed by the exposure to actinic radiation is "developed" by immersing the emulsion in a chemical "developer" which converts the silver halide to microscopic grains of very black metallic silver.

After the developing operation, the developer is washed out of the emulsion, and the emulsion is "fixed" by immersing the emulsion in a chemical which, among other effects, dissolves the unconverted silver halide out of the emulsion. This leaves behind the image in the form of grains of black metallic silver in a density that is the inverse or reverse of the image impressed on the emulsion. That is, in areas where high levels of actinic radiation struck the emulsion, a very large proportion of the silver halide was sensitized and converted to black metallic silver. The high density of black metallic silver grains results in an area of the developed image which is very dense and dark. In areas where less actinic radiation strikes the emulsion, a much lower proportion of the silver halide is converted to black metallic silver; and the portion of the resulting image in those areas is very light with almost no granules of black metallic silver present in the developed emulsion.

The normal development process described above results in a "negative" image of the object photographed, that is, the image tonality is opposite of the object to which the emulsion was exposed. Such emulsions that are normally developed to produce a negative image are said to be "negative acting." If a positive image of the object is desired, that is, an image where tonality is the same as the object to which the emulsion was exposed, this may be obtained by exposing through the negative image to another photographic emulsion. This two-step method for obtaining a positive image is the one most commonly used. There are, however, other methods which will produce a positive image in one step. Two methods of particular importance are "reversal processing" and "positive acting" duplicating emulsions.

In reversal processing, the emulsion is exposed as usual, and the initial developing step is completed to develop the sensitized silver halide to black metallic silver. After the developer has been washed out of the emulsion, the emulsion is not fixed but rather is subjected to a bleaching bath, of a type well-known to those skilled in photography. Such bleaching baths customarily include dilute sulfuric acid and potassium dichromate, which oxidizes and thus removes the black metallic silver negative image from the emulsion without affecting the remaining undeveloped silver halide. Therefore, after the bleaching operation, the emulsion is again clear and carries a latent "positive" image of the object originally photographed, in the form of unexposed and undeveloped silver halide.

After the bleaching operation, the emulsion is immersed in a clearing bath which neutralizes any remaining portion of the bleaching chemicals remaining in the emulsion. The emulsion is then subjected to a general exposure to actinic radiation which sensitizes all of the remaining silver halide. This reexposed image is then developed in a developer bath to convert all of the remaining silver halide to black metallic silver. After development, the emulsion is washed and then fixed to remove any spurious silver halide which has not been properly operated on by the radiation and developer. The resulting image is a positive transparency of the object photographed.

In order to obviate the extra steps involved in reversal processing of normal emulsions, "duplicating film" is often used in the production of positive images for use in the graphic arts industry. Duplicating film uses one of many well-known image-reversal effects in which the film is first exposed overall to actinic radiation or to a chemical fogging treatment. This exposure "fogs" the film by sensitizing the silver halide grains over the entire emulsion. If the film were then to be developed, it would be a uniform black.

In order to employ one of those effects, the fogged, undeveloped film is exposed to actinic radiation by exposing the film to an illuminated object such as a line drawing or a page of typed copy.

The exposure to the actinic radiation from the light areas of the object desensitizes the silver halide of the emulsion. Thus, actinic radiation lightens the latent image in the emulsion in those areas where the actinic radiation from the object strikes the emulsion. Normal development of this type of film results in a high density of black metallic silver in those areas which were initially fogged and exposed to the dark areas of the object. It also results in a lesser density of the developed image in the emulsion in those areas which were exposed to lighter portions of the object being photographed.

In addition to the many and well-known normal-processing, image-reversal phenomena such as the solarization, Clayden, Villard and Herschel effects, a number of patents have issued in recent years directed to shell-grain or covered grain, positive acting emulsions for normal-processing, positive image photography. Reference is made to U.S. Pat. Nos. 3,206,313 granted to Porter et al. on Sept. 14, 1965; 3,632,340 granted to Illingsworth on Jan. 4, 1972; 3,367,778 granted to Berriman on Feb. 6, 1968 and 3,317,322 granted to Porter et al. on May 2, 1967.

Manufacturers of positive acting film do not normally publish information disclosing the manner in which their emulsions achieve a positive image. However, a widely-used, positive acting or positive image duplicating film is marketed by the Eastman Kodak Company under the designation LPD precision line film. E. I. DuPont de Nemours & Company (Inc.) Photo Products Department, Wilmington, Del. 19898, also markets a positive acting duplicating film under the designation CRONALAR SD. These films are exposable in white light and exhibit a photographic "speed" comparable to high-contrast, orthochromatic negative-working reproduction films such as Eastmen Kodak KODALINE Reproduction Film 2566.

Photographic image definition is often used to express the overall quality of the image and is sometimes broken down into many different aspects including: tone, graininess, sharpness and resolution. While tone is important in some applications, the preferred embodiment of the present invention is directed more to high contrast uses of photographic processes in which tone is not a factor. Graininess is controlled in the manufacture of the emulsion and the developers used and is not particularly affected by the present invention. The present invention improves image definition by affecting the sharpness and resolution of the image in a photographic emulsion.

It is well known in the photographic art that reversal processing to produce a positive image reduces the definition of the film and makes for a fuzzier and less precise image on the emulsion.

SUMMARY OF THE INVENTION

In accordance with the present invention, the definition of a photographic emulsion of the positive acting type that would normally produce a positive image is improved by normally exposing the emulsion to actinic radiation and developing the photographic emulsion, bleaching it, exposing the emulsion again to actinic radiation and redeveloping it to reverse the image that would normally result on the film.

BRIEF DESCRIPTION OF THE DRAWINGS

The present invention will be more fully understood from the following detailed description when considered in conjunction with the accompanying drawing wherein the same reference numbers are used to designate the same or a similar process step in the several diagrams in which.

DETAILED DESCRIPTION

Figure 1:
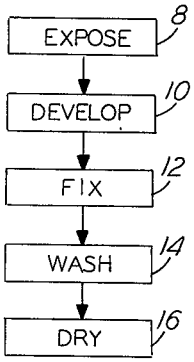
FIG.-1 (PRIOR ART)
FIG. 1 is a flow diagram of the normal method of producing a negative image in a photographic emulsion.

Referring now to the drawing and more particularly to FIG. 1, after a conventional photographic emulsion is exposed in an EXPOSE step 8 to actinic radiation in a pattern of light and dark or high and low intensities of radiation to correspond to the image of the object being photographed, the film is subjected to a bath of developer in a DEVELOP step 10 which converts the silver halide contained in the emulsion to black metallic silver crystals or grains which darken the emulsion. The emulsion is then subjected to a fixing chemical bath in a FIX step 12 which removes the undeveloped silver halide to prevent fogging or darkening deterioration of the emulsion over time. Any remaining developer or fixing chemical is then washed from the emulsion in a WASH step 14. The emulsion is then dried in a DRY step 16.

Figure 2:
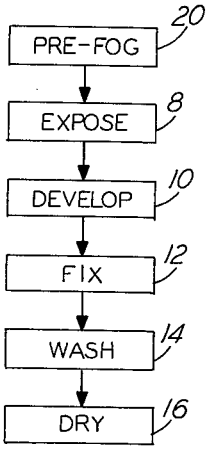
FIG.-2 (PRIOR ART)
FIG. 2 is a flow diagram of the normal method of producing a positive image in a positive acting emulsion.

Referring now to FIG. 2, some photographic film is manufactured to be positive acting for purposes which may require a positive image. The emulsion is fogged in a PRE-FOG step 20 by the photographer before using it or more commonly, by the manufacturer before the film is sold to the trade.

The photographer exposes the pre-fogged emulsion to an illuminated object for an appropriate exposure time in an EXPOSE step 8. Actinic radiation striking selected areas of the emulsion appears to desensitize the silver halide in those areas almost as though it had never been fogged in the first place. These are areas of the emulsion that correspond to the bright or light areas of the object which reflect a lot of the object illumination which is then projected onto the emulsion by the camera.

The dark areas of the object absorb most of the illuminating radiation that strikes them and reflect very little. Therefore, the amount of object illumination that is reflected from these dark areas of the object onto the corresponding areas of the emulsion is very slight. Such a small amount of radiation is insufficient to desensitize or unfog the silver halide in those areas of the emulsion that correspond to the dark areas of the object.

After the pre-fogged positive acting or duplicating emulsion has been exposed to the illuminated object, it is put into a developer in a DEVELOP step 10 as in the example of the normal process set forth in FIG. 1.

After the undesensitized silver halide has been developed to black metallic silver in the DEVELOP step 10, the emulsion is then fixed in a FIX step 12, immersed in clean water in a WASH step 14, and dried in a DRY step 16. The black metallic silver grains are then only present in those areas of the emulsion that correspond to dark, light-absorbing areas of the object. Since dark areas of the emulsion correspond to dark areas of the object, the image is a positive image.

Figure 3:
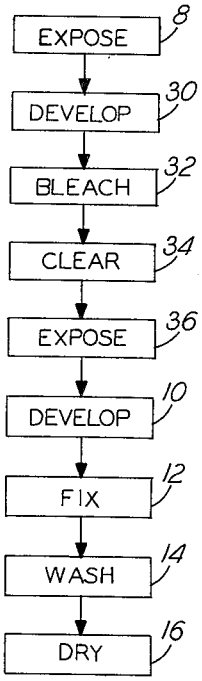
FIG.-3 (PRIOR ART)
FIG. 3 is a flow diagram illustrating reversal processing used to produce a positive image in an emulsion of the type which normally achieves a negative image.

Referring now to FIG. 3, the process steps are shown for producing a positive image in an emulsion intended to produce a negative image. The emulsion is first exposed in a camera or otherwise, in an EXPOSE step 8. The emulsion is then immersed in a developer in a DEVELOP step 30. The developer is preferably of a commercially-available type intended for use as the first developer in a reversal processing system. While the suppliers of photographic materials generally do not publish the formulas for their commercial products, it is believed that most first developers for reversal processing contain the halide solvent potassium thiocyanate.

The purpose of this solvent is to dissolve and eliminate the smallest or least-sensitive grains of silver halide and deposit the dissolved silver halide on the larger grains, making them even more sensitive. The amount of growth in grain size that results is not believed to appreciably affect graininess of the image. If these smallest grains were not dissolved they could be expected to increase the density or darkness of the lightest areas of the finished emulsion.

After the first DEVELOP step 30, the black metallic silver in the emulsion is removed in a BLEACH step 32 which involves immersion of the emulsion in a bath containing dilute sulfuric acid, although commercially available photographic bleaching baths are preferred. A thrifty photographer would probably wash the emulsion in clean water between the DEVELOP step 30 and the BLEACH step 32.

After bleaching out the black metallic silver, the emulsion is immersed in a neutralizing or clearing bath, usually containing sodium sulfite, in a CLEAR step 34. A commercially available clearing bath is preferred. It may also be desirable to wash the emulsion in clean water between the BLEACH step 32 and the CLEAR step 34.

The bleached emulsion is then given a general exposure to actinic radiation in an EXPOSE step 36 which sensitizes all of the remaining silver halide. The now reexposed emulsion is treated in a conventional DEVELOP step 10, a FIX step 12, a WASH step 14, and a DRY step 16. This results in black areas in all portions of the emulsion that were light after the first DEVELOP step 30 and light in the areas that were black.

Figure 4:
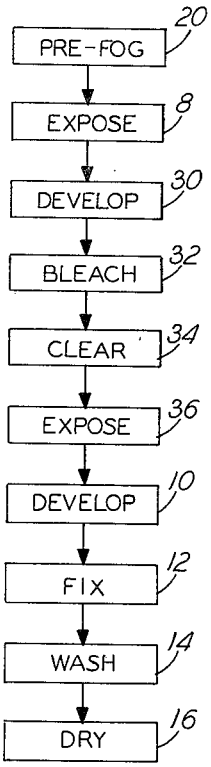
FIG. 4 is a flow diagram of a method according to the present invention, of improving the definition of the image in a positive acting photographic emulsion.

Referring now to FIG. 4, a preferred embodiment of the present invention is shown. An emulsion, preferably of a positive acting, duplicating film, that has been prefogged in a PRE-FOG step 20 either by the photographer or by the manufacturer before marketing, is exposed in an EXPOSE step 8.

As with the duplicating film described in connection with FIG. 2, exposure of the pre-fogged emulsion to the desired illuminated object desensitizes or unfogs the emulsion in the areas of the film corresponding to the bright areas of the object. The exposed emulsion is then immersed in a developer in a DEVELOP step 30. The developer develops the latent image to produce the black metallic silver particles which correspond to the fogging that was given to the film initially. The DEVELOP step 30 produces a lower density of black metallic silver grains in those areas in which the emulsion was desensitized in the EXPOSE step 8.

At this point, the developer may be washed from the emulsion. The emulsion is then immersed in a bleaching solution in a BLEACH step 32 to remove the developed black metallic silver grains. After the BLEACH step 32, the bleaching material can be washed from the emulsion; and the emulsion is immersed in a neutralizing solution in a CLEAR step 34. If desired, the emulsion can again be washed and if desired, can be dried before it is generally exposed to actinic radiation in an EXPOSE step 36 to sensitize the silver halide that had been desensitized in the EXPOSE step 8.

Following this general resensitizing in the EXPOSE step 36, the emulsion is immersed in a conventional developer in a DEVELOP step 10. In this DEVELOP step 10, the remaining silver halide is developed to black metallic silver in order to produce a dark, dense image in areas corresponding to the light areas of the object that was photographed, thereby producing a negative image.

After the DEVELOP step 10, the emulsion is then placed in a fixing bath to remove any spurious, undeveloped silver halide in a FIX step 12 in order to prevent darkening of the light areas of the emulsion in the future. After fixing, the emulsion is washed in a WASH step 14 and then is dried in a DRY step 16.

It has been found that reversal processing of positive acting emulsions produces developed images of much greater definition than would be expected with comparable negative acting emulsions or even with the positive acting emulsions when normally processed. It is not known why reversal processing improves the definition of an image in a positive acting emulsion. The applicants have even speculated that reversal processing of a positive acting emulsion may reverse in some way the degradation of the image that is known to result from reversal processing of a negative acting emulsion to obtain a positive image.

One skilled in the art may make various changes to the above-described processes without departing from the spirit and scope of the invention.

What is claimed is:

1. A method of improving the definition of the image on a photographic emulsion, including the steps of:

exposing a pre-fogged photographic emulsion to actinic radiation representative of an object to produce in the emulsion a latent positive image of the object;

developing the positive image of the object;

bleaching the positive image from the emulsion;

generally exposing the emulsion to actinic radiation to produce a latent negative image of the object; and developing the negative image of the object.

2. A method of improving the definition of the image of an object, present in a positive acting, photographic emulsion including the steps of:

exposing the positive acting emulsion to actinic radiation in the image of the object so as to produce a latent positive image of the object;

developing the latent positive image in the emulsion to make patent the positive image of the object;

removing the developed positive image from the emulsion;

exposing the entire emulsion to actinic radiation; and developing the emulsion.

3. A method according to claim 2, wherein the step of developing the latent positive image in the emulsion comprises producing greater image density in areas of the emulsion where less actinic radiation strikes the emulsion and producing less image density in areas of the emulsion where more actinic radiation strikes the emulsion.

4. A method according to claim 2, wherein the developed image is removed by subjecting the emulsion to a chemical which dissolves the portion of the emulsion which constitutes its image.

5. A method according to claim 4, wherein the second developing step comprises producing greater image density in areas of the emulsion where more image-representing actinic radiation strikes the emulsion and producing less image density in areas of the emulsion where less image-representing actinic radiation strikes the emulsion.

6. A method for improving the image definition of a positive acting photographic emulsion comprising the steps of:

exposing the positive acting emulsion to actinic radiation in the image pattern of an object that is the negative of the image to be recorded on the positive acting emulsion, thereby producing a latent image in the emulsion that is a positive representation of the photographed object; and processing the emulsion so as to produce a reversal of the image in the emulsion from a positive representation of the photographed object to a negative representation of the photographed object.

* * * * *

UNITED STATES PATENT AND TRADEMARK OFFICE

CERTIFICATE OF CORRECTION

PATENT NO. : 4,327,172

DATED : April 27, 1982

INVENTOR(S) : Charles E. Martin And Ervin J. Rachwal

It is certified that error appears in the above-identified patent and that said Letters Patent is hereby corrected as shown below:

On the title page, Assignee should read:

-- Charles E. Martin Assor. to Western Electric Company, Inc., New York, N. Y. --.

Signed and Sealed this

*Fifteenth* Day of *March 1983*

[SEAL]

*Attest:*

GERALD J. MOSSINGHOFF

*Attesting Officer*

*Commissioner of Patents and Trademarks*